US006775964B2

(12) United States Patent
Rodgers

(10) Patent No.: US 6,775,964 B2
(45) Date of Patent: Aug. 17, 2004

(54) CAVESON FOR USE WITH HORSES

(75) Inventor: William E. Rodgers, Streetsboro, OH (US)

(73) Assignee: Mondial Industries, Ltd., Hudson, OH (US)

( * ) Notice: Subject to any disclaimer, the term of this patent is extended or adjusted under 35 U.S.C. 154(b) by 0 days.

(21) Appl. No.: 10/680,640

(22) Filed: Oct. 7, 2003

(65) Prior Publication Data

US 2004/0065061 A1 Apr. 8, 2004

Related U.S. Application Data

(63) Continuation of application No. 10/137,596, filed on May 2, 2002, now abandoned.

(51) Int. Cl.[7] ..... B68B 1/04
(52) U.S. Cl. ..... 54/6.1
(58) Field of Search ..... 54/6.1, 6.2, 13, 54/24

(56) References Cited

U.S. PATENT DOCUMENTS

| | | | | | |
|---|---|---|---|---|---|
| 200,720 | A | * | 2/1878 | Henkell | 54/24 |
| 250,019 | A | * | 11/1881 | Venable | 54/6.1 |
| 293,108 | A | * | 2/1884 | Sutphen | 54/6.1 |
| 565,681 | A | | 8/1896 | Hutton | |
| 1,015,165 | A | * | 1/1912 | Fox | 54/6.1 |
| 2,630,660 | A | * | 3/1953 | Thomas | 54/6.1 |
| 3,949,538 | A | | 4/1976 | Woodruff | |
| 3,998,033 | A | | 12/1976 | Watkins et al. | |
| 4,337,610 | A | | 7/1982 | Taylor | |
| 4,343,136 | A | | 8/1982 | Le Tixerant et al. | |
| 4,459,795 | A | | 7/1984 | Le Tixerant | |
| 4,472,925 | A | | 9/1984 | Woodruff | |
| 4,480,427 | A | | 11/1984 | Conrad | |
| 4,495,752 | A | | 1/1985 | Simpson | |
| 4,495,753 | A | | 1/1985 | Simpson | |
| 4,524,569 | A | | 6/1985 | Hanna | |
| 4,565,055 | A | | 1/1986 | Simpson | |
| 4,722,171 | A | | 2/1988 | Meroth | |
| 4,798,043 | A | | 1/1989 | Wyse | |
| 4,852,336 | A | * | 8/1989 | Gammill | 54/24 |
| 4,999,980 | A | | 3/1991 | McGowan | |
| 5,079,904 | A | | 1/1992 | Berube | |
| 5,086,611 | A | | 2/1992 | Purdy | |
| 5,174,097 | A | * | 12/1992 | Muratore | 54/6.1 |
| 5,615,539 | A | | 4/1997 | Graham | |
| 5,660,031 | A | | 8/1997 | Clark | |
| 6,202,393 | B1 | | 3/2001 | Myler et al. | |

FOREIGN PATENT DOCUMENTS

| | | |
|---|---|---|
| DE | 29720858 | 1/1998 |
| DE | 19731635 | 2/1998 |
| GB | 2264218 | 8/1993 |
| GB | 2310123 | 8/1997 |

OTHER PUBLICATIONS

Lea & Sachs, Inc.—"Woven & Knit Elastic"—www.leasachs.com—May/2002, pp. 1–3, U.S. –Internet.

(List continued on next page.)

*Primary Examiner*—Robert P. Swiatek
(74) *Attorney, Agent, or Firm*—Reinhart Boerner Van Deuren s.c.

(57) ABSTRACT

A caveson which may be used with horses is disclosed in which the caveson allows for limited movement of the horse's mouth during breaking and training of the horse and thereafter. The caveson has a noseband constructed at least in part of a resilient material, allowing enough movement of the horse's mouth to prevent pain or discomfort while exerting progressive and constant pressure on the horse's nose when the horse opens its mouth or crosses its jaws, ensuring that the trainer or rider will maintain control and communication with the horse through the bit. The noseband together with an adjustable jaw strap form a circular segment that fits around the horse's nose and is maintained in position on the horse's head by a headstall which is connected at opposite ends to the circular segment and which is configured to run behind the horse's ears.

57 Claims, 11 Drawing Sheets

OTHER PUBLICATIONS

State Line Tack, Inc., Catalog pp. 128, 131, 179, 180, 72, 73—Available as of Mar. 2002, U.S.

State Line Tack, Inc., "State Line Tack Premium Nylon Halter with Snap"—Jul. 23, 2002—www.statelinestack.com—U.S. –Internet.

Congress Leather, 'Arabian show Halters—www.congress-leather.com—pp. 1–3——U.S. –May 22, 2002 –Internet.

Exclusively Arabian, "Brown and Gold Halter"—www.Egyption–erabian.com—May 22, 2002—pp. 1–3 –Internet.

Show Stopper Tack, Inc., "SS Weymouth Show Bit"—www.showstoppertack.com–13 Jul. 19, 2002—pp. 1–3—U.S. –internet.

Diamond R. Saddlery, "Curb Chains, Strape & Headstalls"—www.diamondrsaddlery.com—Jul.19, 2002—pp. 1–6—U.S. –Internet.

Turners's Saddlery & Western Wear, "BITS"—www.tumer-saddlery.com—Jun. 20, 2002 —pp. 1–4—U.S. –Internet.

Horse Data, "Points of a Bridle"—www.horsedata.co.uk/points_of_a_bridle.htm—2–2—UK –Intarnet.

Brown Paula, "The Humble Halter—Worth a Second Look"—www.clipciop.com—May 22, 2002—pp. 1–3—U.S. –Internet.

Horse Health USA, "Riveted Leather Halters"—www.horsehealthusa.com—May 22, 2002—pp. 1—U.S. –internet.

An English Translation of German Patent DE 19731635.

* cited by examiner

FIG. 17
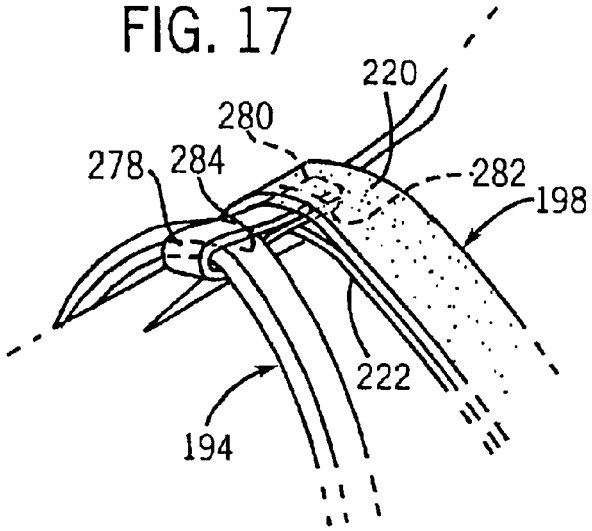
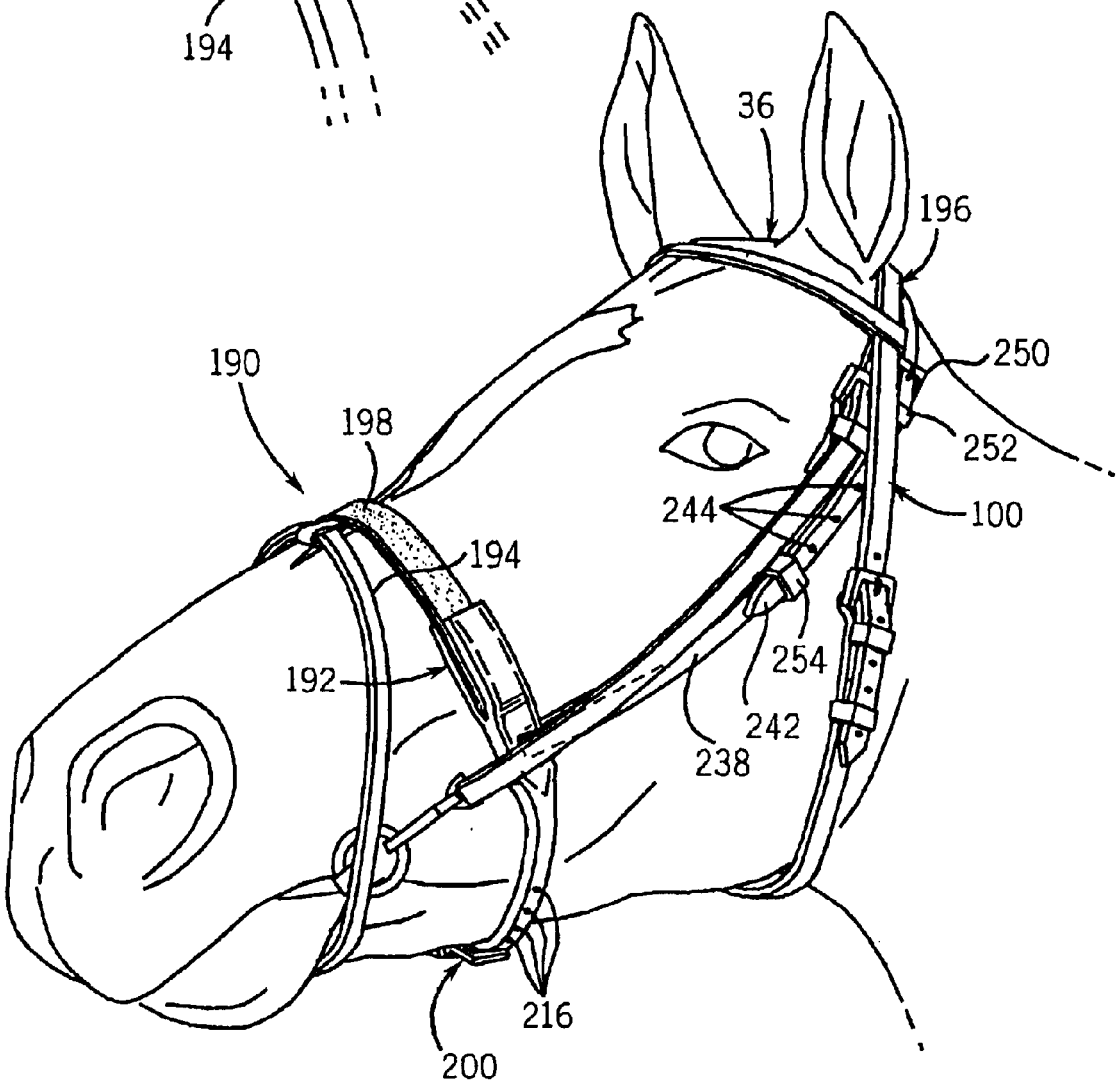
FIG. 18

CAVESON FOR USE WITH HORSES

IDENTIFICATION OF RELATED APPLICATIONS

This application is a continuation of U.S. patent application Ser. No. 10/137,596, entitled "Caveson for Use With Horses," which was filed on May 2, 2002, now abandoned the entirety of which is incorporated herein by reference.

BACKGROUND OF THE INVENTION

Field of The Invention

The present invention relates generally to tack, and more specifically to a caveson for use with horses in which the caveson allows for limited movement of the horse's mouth.

A bridle made of a framework of leather straps and having a bit is placed on a horse's head and used by a rider to control the horse's movement. Control or communication with the horse is achieved by pulling on the reins, which are attached to the bridle and thereby transmit pressure to the horse's head through the bridle and the bit. A caveson fits underneath the bridle to prevent the horse from avoiding the action of the bit by opening its mouth. Accordingly, training a horse to accept a bit and a bridle is essential for proper communication and control of a horse throughout its life.

A caveson is thus positioned on a horse for the purpose of ensuring that the horse holds a bit correctly in its mouth, with the caveson preventing the horse from excessively opening its mouth while being ridden. Further, a caveson aids in training a horse to accept a bridle and bit. By virtue of inhibiting the level to which the horse can open its mouth, a caveson also controls breathing and the tendency for the horse to run away with its rider.

A caveson resembles a well fitting halter and includes a circular segment comprised of a noseband and a jaw strap which together encircle the horse's jaw and a retaining strap or headstall that holds the noseband in position. The noseband, secured relatively tightly around the horse's nose by the jaw strap, acts on the horse's nasal bone to control and guide the horse. The impact on the horse is determined by the tightness of the jaw strap on the underside of the noseband.

Because of its use as a training device, the caveson noseband is traditionally made of a rigid, inelastic material, such as thick bridle leather, nylon or metal. In some instances, the caveson can include even harsher materials on the noseband such as metal studs, to encourage the horse to keep its mouth closed while being ridden. While some rigid cavesons include padding on the underside of the noseband to improve comfort, the caveson materials themselves are rigid and inelastic to prevent opening of the horse's mouth.

However, some horses are not easily trained or accepting of these rigid cavesons. Rigid or harsh cavesons used to provide negative reinforcement during training often proves unsuccessful in achieving results. The use of a rigid caveson is painful and uncomfortable for the horse, and may be ineffective in training and lead to less inverted working attitudes (head up).

It is accordingly the primary objective of the present invention to provide a caveson for use in horse training and thereafter which will allow limited movement of the horse's mouth during training and allow the horse to adapt gently to the concept of a mouth constraint. It is a related objective of the present invention to provide a caveson in which the noseband is comprised at least in part of a resilient material, allowing enough movement of the horse's mouth to prevent pain or discomfort while exerting progressive and constant pressure on the horse's nose when the horse opens his mouth or crosses his jaw, ensuring that the trainer or rider maintains control and communication with the horse through the bit.

It is a further objective of the present invention to provide a caveson with an adjustable jaw strap thereby permitting a trainer or rider to vary the circumference of the circular portion of the caveson according to the size of the horse's nose. It is a related objective of the present invention to provide a caveson with an adjustable headstall thereby permitting a trainer or rider to vary the size of such headstall allowing the caveson to be fitted and used on more than one horse.

It is a further objective of the caveson of the present invention that the caveson jaw strap may optionally be made of at least in part a resilient material to allow limited movement of the horse's mouth while acting in cooperation with the caveson noseband to exert progressive and constant pressure on the horse's nose, ensuring the horse's mouth is sufficiently closed to properly engage with the bit. It is an additional objective of the present invention to provide a caveson for use in horse training and thereafter that optionally includes a headstall made at least in part of a resilient material to further provide comfort to the horse while working with the noseband and the jaw strap to maintain pressure on the horse's nose.

The caveson of the present invention must also be of construction which is both durable and long lasting, and it should also require little or no maintenance to be provided by the user throughout its lifetime. In order to enhance the market appeal of the cavason of the present invention, it should also be of inexpensive construction to thereby afford it the broadest possible market. Finally, it is also an objective that all of the aforesaid advantages and objectives of the caveson of the present invention be achieved without incurring any substantial relative disadvantage.

SUMMARY OF THE INVENTION

The disadvantages and limitations of the background art discussed above are overcome by the present invention. With this invention, a caveson for use in horse training and thereafter is provided which consists of a circular segment that is fitted around the horse's nose and a headstall, attached to the circular segment and placed behind the horse's ears to secure the caveson on the horse's head.

The circular segment includes an upper portion consisting of a noseband, having first and second ends, and a lower portion consisting of a jaw strap, also having first and second ends, with the first ends of the noseband and the jaw strap secured to each other and the second ends of the noseband and the jaw strap secured to each other, thereby forming the circular segment. In the preferred embodiment, the noseband is secured to the jaw strap by permanently stitching the ends together.

The noseband of the caveson of the present invention is constructed, at least in part, of a resilient material, allowing the noseband to yield slightly in response to movement of the horse's mouth. In the preferred embodiment, the noseband is constructed of two layers of resilient material, placed directly on top of each other and affixed together permanently by stitching or other well-known methods. In an alternate embodiment, the noseband of the caveson of the present invention is constructed, at least in part, of a resilient material that not only exhibits elastic properties but which also imparts softness and conformability to the shape of the horse's nose at the points of contact, such as woven elasticized materials.

The jaw strap of the caveson of the present invention includes an adjustment mechanism for securing the circular segment around the horse's nose and varying the circumference of the circular segment. In the preferred embodiment, the jaw strap includes a buckle that allows the circular segment to be adjusted in circumference, depending upon the size of the horse's nose and the amount of pressure on the horse's nose required by the trainer or rider. In the preferred embodiment, the buckle is positioned within the jaw strap such that when the buckle is fastened to the desired circumference, it is located on the underside of the horse's nose.

The caveson of the present invention also includes a headstall which consists of a strap having first and second ends which are relatively secured to the circular segment of the caveson on opposite sides thereof so that the headstall forms a loop which runs from one side of the circular segment to a location behind the horse's ears, and back to the opposite side of the circular segment. The headstall also includes means for adjusting the size thereof and for ensuring that the headstall is securely fitted behind the ears of the horse. In the preferred embodiment, the headstall consists of two segments, each segment having first and second ends, wherein the first ends are each secured to the circular portion of the caveson on opposite sides of the horse's nose, and the second ends are fastened together by a buckle. In this embodiment, the length of each segment is such that when the buckle is fastened, the buckle is located on the side of the horse's head.

In alternate embodiments, either the jaw strap or the headstall, or both, may be constructed, at least in part, of a resilient material, allowing additional movement of the horse's mouth.

In yet another embodiment, the caveson is provided with an additional component, namely a crown piece strap which is connected at each end to opposite sides of the headstall, and is located so as to run along the forehead of the horse. This crown piece may be constructed of leather or any other commonly used material known in the art.

In further alternative embodiments, the caveson is provided with a second circular segment that is connected to first circular segment at a point on the noseband of the caveson that is directly on the bridge of the horse's nose and extends around the horse's chin in front of the bit, encircling the horse's nose. The second circular segment may also be constructed, at least in part, of a resilient material, allowing for additional control over movement of the horse's mouth.

It may therefore be seen that the caveson of the present invention overcomes the disadvantages of the prior art by providing a comfortable and humane caveson that can be used for training horses and thereafter, wherein the noseband is constructed in part of a resilient material that allows movement of the horse's mouth while also acting in conjunction with the jaw strap to apply light and continuous pressure to the horse's nose, encouraging the horse to keep its mouth closed while being ridden. It may thus be seen that the present invention provides a caveson for use in horse training and thereafter without the need for harsh, painful, and inelastic components previously seen in the prior art.

The caveson of the present invention is of a construction which is both durable and long lasting, and which will require little or no maintenance to be provided by the user throughout its lifetime. The caveson of the present invention is also of inexpensive construction to enhance its market appeal and to thereby afford it the broadest possible market. Finally, all of the aforesaid advantages and objectives of the caveson of the present invention are achieved without incurring any substantial relative disadvantage.

DESCRIPTION OF THE DRAWINGS

These and other advantages of the present invention are best understood with reference to the drawings, in which:

FIG. 17 is a partial perspective view of the caveson illustrated in FIGS. 12 through 16, showing a detailed depiction of the connection of the second circular segment to the first circular segment;

FIG. 18 is a perspective view of a horse wearing the caveson illustrated in FIGS. 12 through 17 positioned underneath a bridle;

DETAILED DESCRIPTION OF THE PREFERRED EMBODIMENT

Figure 1:
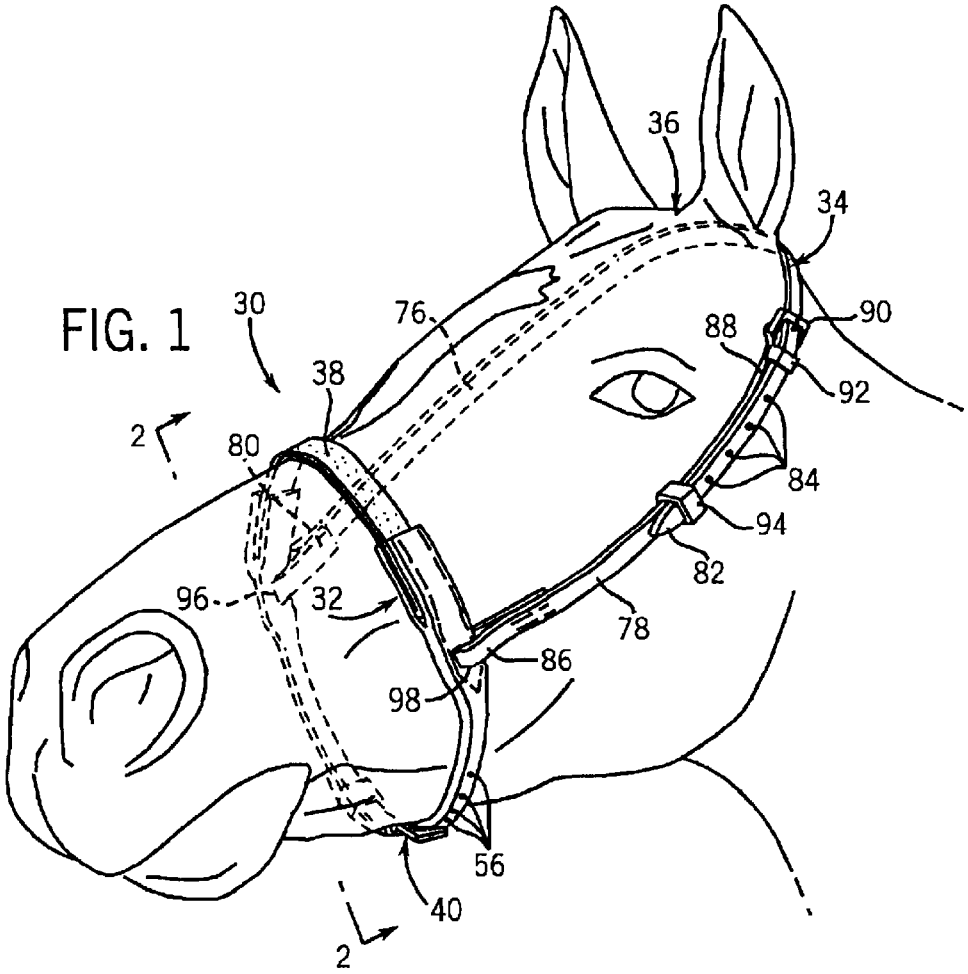
FIG. 1 is a perspective view of a horse wearing a caveson constructed according to the teachings of the present invention.
Figure 2:
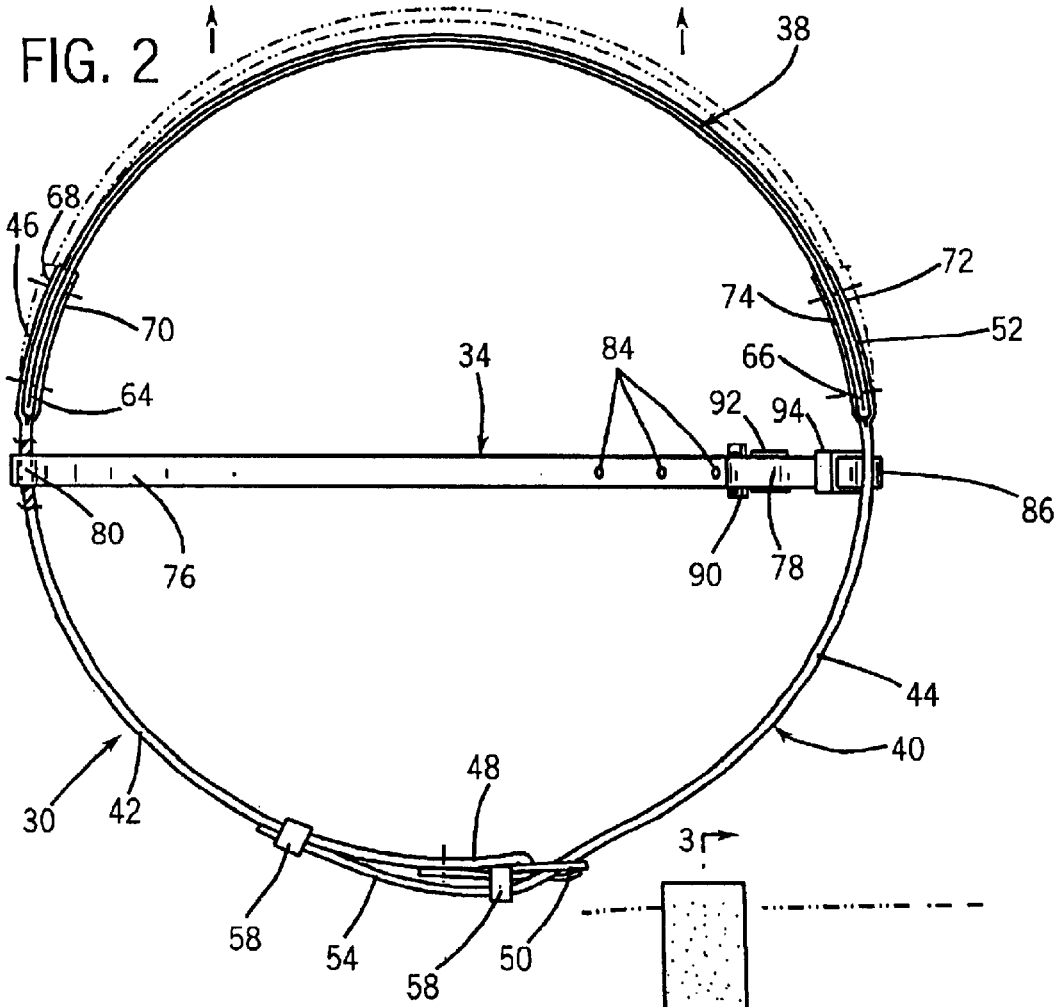
FIG. 2 is a front view of the preferred embodiment shown in FIG. 1.

FIGS. 1 and 2 illustrate the preferred embodiment of a caveson 30 which is consistent with the teachings of the present invention. As illustrated in FIG. 1, the caveson 30 in its simplest form consists of a circular segment 32 that fits around the horse's nose and a headstall 34 that is connected to the circular segment 32 on opposite sides thereof and runs behind the horse's ears to maintain the caveson 30 in place on horse's head 36.

The circular segment 32 of the caveson 30 consists of a noseband 38 that runs over the nasal bone of the horse and a jaw strap indicated generally at 40 that makes up the lower portion of the circular segment 32.

The jaw strap 40 of the caveson 30 is used to adjust the size of the circular segment 32, to accommodate different size horse noses, and to vary the amount of pressure to be applied to the horse's nose. The jaw strap 40 consists of two segments, a first segment 42 and a second segment 44. The first segment 42 has a first end indicated generally at 46 which is attached to the noseband 38, and a second, opposite end indicated generally at 48 which is connected to a buckle 50 or similar mechanism for removably fastening the first segment 42 to the second segment 44. The second segment 44 has a first end indicated generally at 52 which is attached to the noseband 38, and a second, opposite end indicated generally at 54 which contains a series of regularly spaced apertures 56 (best shown in FIGS. 1 and 4) which will receive the buckle 50.

FIG. 2 best illustrates the manner in which the first segment 42 is provided with buckle loops 58 located close to the buckle 50 for retaining the second end 54 of the second segment 44 after the jaw strap 40 has been buckled into place. The relative lengths of each of the segments 42 and 44 of the jaw strap 40 is such that when the buckle 50 is fastened, it is located on the underside of the horse's nose.

Figure 3:
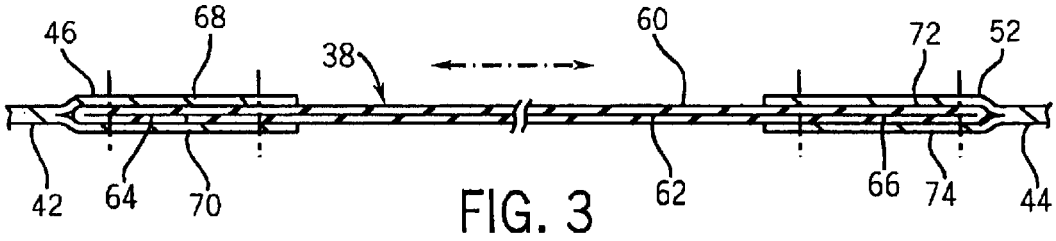
FIG. 3 is a cross-sectional view of the caveson illustrated in FIGS. 1 and 2, showing a detailed depiction of the connection of the noseband to the jaw strap which forms the circular segment.

Referring for the moment to FIG. 3, the preferred embodiment of the noseband 38 consists of a first layer 60 and a second layer 62 of a resilient material of identical width and length, stitched or otherwise joined together permanently in a manner known to those skilled in the art, forming a single reinforced band of resilient material. The noseband 38 has a first end indicated generally at 64 and a second, opposing end indicated generally at 66, in which ends 64 and 66 are used to connect the noseband 38 to the jaw strap 40. In an alternate embodiment, one or more layers of the noseband 38 may be constructed of a material that is not only elastic but also is soft and conforms to the shape of the horse's nose at the points of contact.

In accordance with the present invention, the noseband 38 is connected to the jaw strap 40, forming the circular segment 32 (shown in FIGS. 1 and 2). FIG. 3 also illustrates a detailed view of the connection of the noseband 38 to the jaw strap 40 of the preferred embodiment. The first end 46 of the first segment 42 of the jaw strap 40 is split into two layers, namely a first layer 68 and a second layer 70. The first end 64 of the noseband 38 is inserted between the first layer 68 and the second layer 70, and the resulting joint is stitched or otherwise permanently joined together in a manner known to those skilled in the art.

Likewise, the second end 52 of the second segment 44 of the jaw strap 40 is split into two layers, namely a first layer 72 and a second layer 74. The second end 66 of the noseband 38 is inserted between the first layer 72 and the second layer 74, and the resulting joint is stitched or otherwise permanently joined together in a manner known to those skilled in the art. In the preferred embodiment, the jaw strap 40 is constructed of leather, although it could instead be made of any other appropriate material that either has two layers or may be split into two layers as previously described. It will at once be appreciated by those skilled in the art that the jaw strap 40 may instead be constructed of one or more layers of resilient material, nylon, rope or any other appropriate material and connected to the noseband 38 to form the circular segment 32 by stitching or in any other manner known to those skilled in the art.

Referring again to FIGS. 1 and 2, the headstall 34 consists of two segments, a first segment 76 and a second segment 78. The first segment 76 has a first end indicated generally at 80 which is attached to the circular segment 32 on the side thereof which will be located on the right side of the nose of the horse's head 36, and a second, opposite end indicated generally at 82 which contains a series of regularly spaced apertures 84. The second segment 78 has a first end indicated generally at 86 which is attached to the circular segment 32 on the side thereof which will be located on the left side of the nose of the horse's head 36, and a second, opposite end indicated generally at 88 which is connected to a buckle 90 or similar mechanism for removably fastening the first segment 76 to the second segment 78. The apertures 84 will receive the buckle 90 when the headstall 34 is fastened onto the horse's head 36.

FIG. 1 illustrates the preferred embodiment of the caveson 30 in which the second segment 78 is provided with a first buckle loop 92 located close to the buckle 90 for retaining the second end 82 of the first segment 76, and a second buckle loop 94 located a distance away from the buckle 90 for further retaining the first segment 76 when the headstall 34 is fastened in place. The relative lengths of each of the segments 76 and 78 is such that when the buckle 90 is fastened, the buckle 90 will rest on the side of the horse's head 36.

Figure 4:
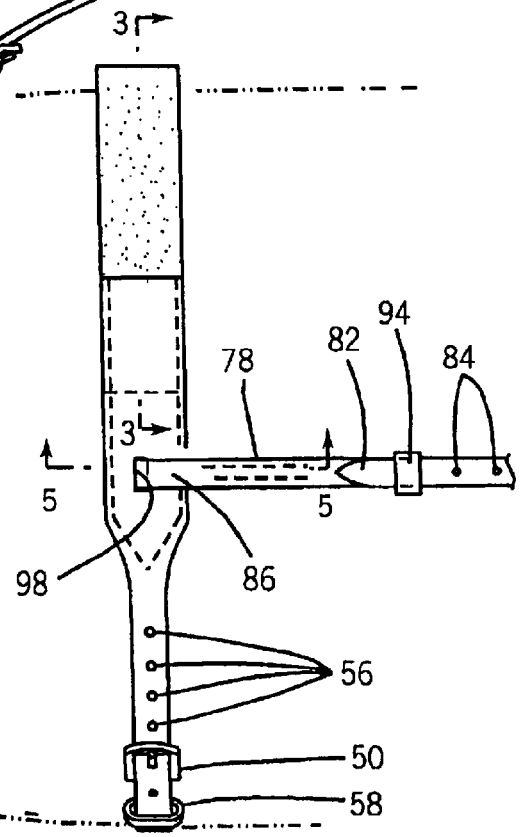
FIG. 4 is a side view of a portion of the caveson illustrated in FIGS. 1 through 3, showing the connection of the noseband to the jaw strap which forms the circular segment, and also showing the connection of the headstall to the circular segment.
Figure 5:
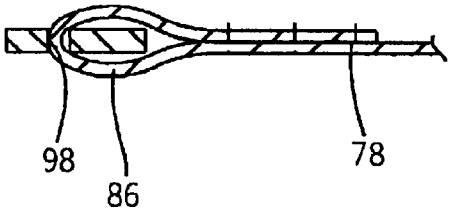
FIG. 5 is a cross-sectional view of the caveson illustrated in FIGS. 1 through 4, showing a detailed depiction of the connection of the headstall to the circular segment.

Referring now to FIGS. 4 and 5 in addition to FIGS. 1 and 2, detailed views of portions of the caveson 30 of the present invention showing the connection of the headstall 34 to the circular segment 32 is provided. The first segment 42 of the jaw strap 40 contains an elongated aperture 96 for receiving one end of the headstall 34. The first end 80 of the first segment 76 of the headstall 34 is looped through the elongated aperture 96 and stitched directly onto itself (as shown in FIGS. 4 and 5), or otherwise permanently joined together in a manner known to those skilled in the art.

Likewise, the second segment 44 of the jaw strap 40 contains an elongated aperture 98 for receiving the other end of the headstall 34. The first end 86 of the second segment 78 of the headstall 34 is looped through the elongated aperture 98 and stitched directly onto itself (as shown in FIGS. 4 and 5), or otherwise permanently joined together in a manner known to those skilled in the art. Note that the elongated apertures 96 and 98 are located on opposite sides of the circular segment 32, and will be respectively located on the right and left sides of the horse's head 36 when the caveson 30 is installed thereupon. It will at once be appreciated by those skilled in the art that the headstall 34 may be connected to the circular segment 32 as described, or alternatively, by stitching it directly to the circular segment 32, or by any other mechanism known to those skilled in the art.

Figure 6:
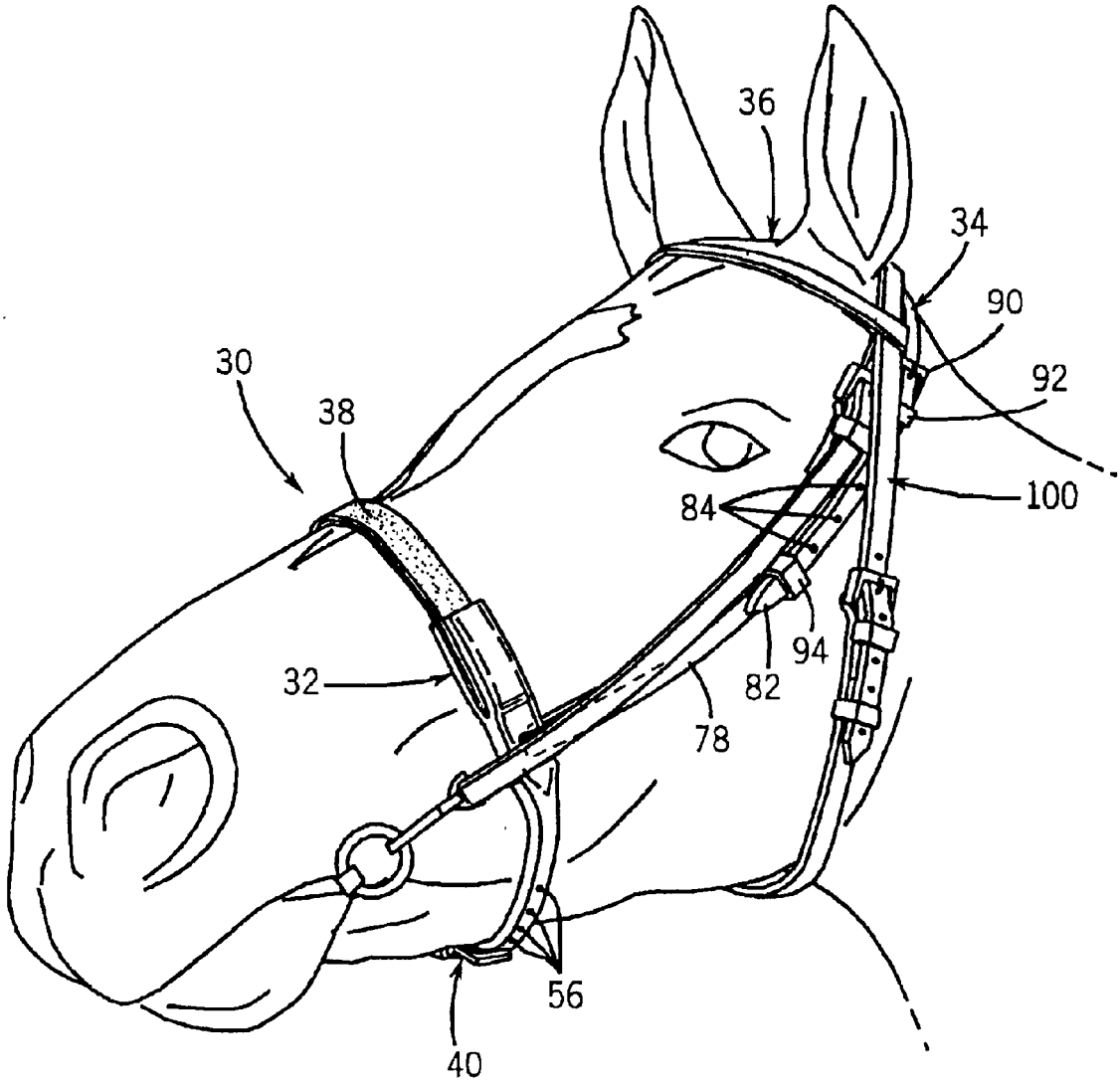
FIG. 6 is a perspective view of a horse wearing the caveson illustrated in FIGS. 1 through 5 positioned underneath a bridle.

Referring now FIG. 6, the preferred embodiment of the caveson 30 is shown on the horse's head 36 located underneath a bridle 100 as would be customary when used in horse training.

Figure 7:
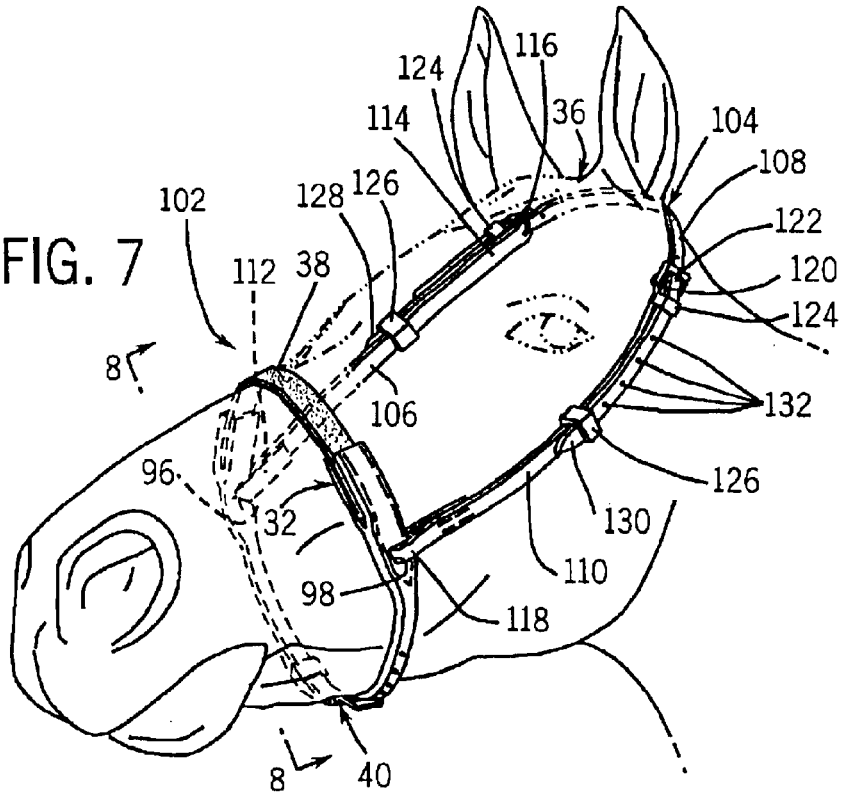
FIG. 7 is a perspective view of a horse wearing an alternate embodiment caveson.
Figure 8:
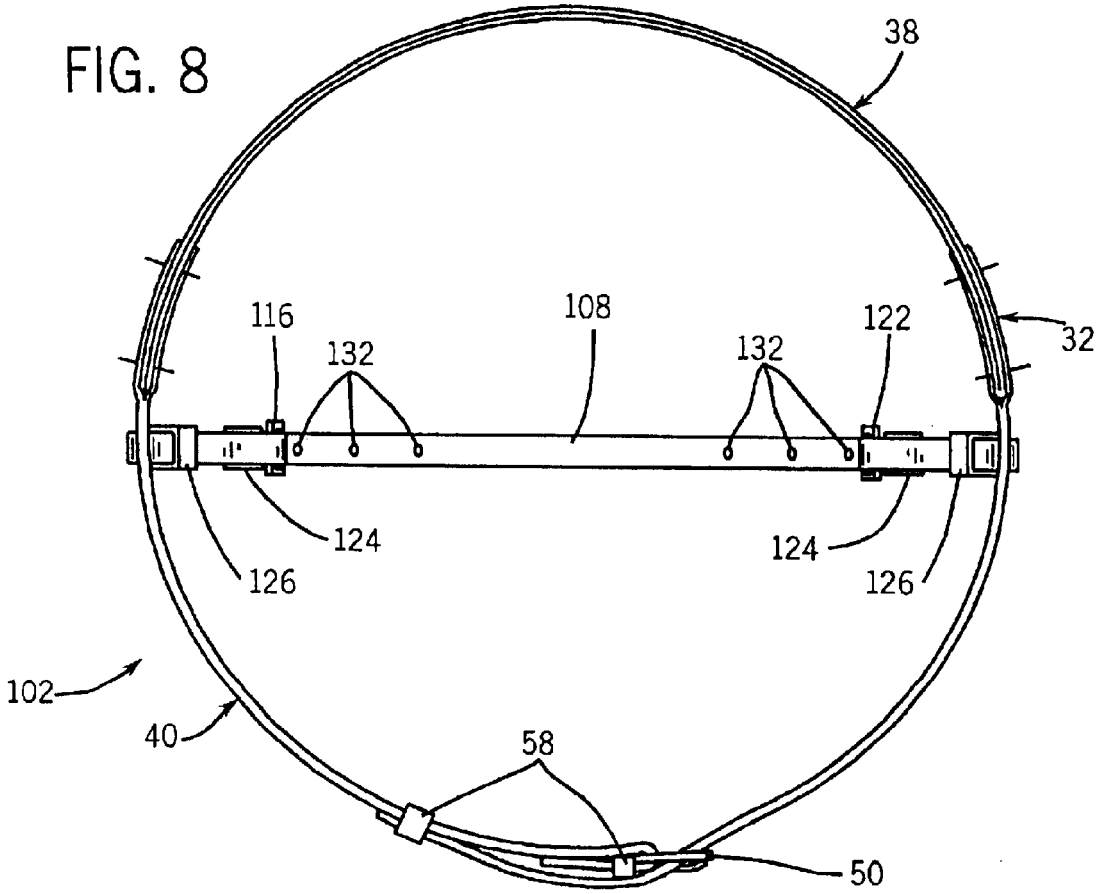
FIG. 8 is a front view of the alternate embodiment caveson shown in FIG. 7.

Referring next to FIGS. 7 and 8, a first alternate embodiment caveson is shown in which caveson 102 consists of a circular segment 32 that fits around the horse's nose and a headstall 104 which is connected to the circular segment 32 on opposite sides thereof and runs behind the horse's ears to maintain the caveson 102 in place on horse's head 36.

In this embodiment, the headstall 104 of the caveson 102 consists of three segments, a first segment 106, a second segment 108 and a third segment 110. The first segment 106 of the headstall 104 has a first end indicated generally at 112 which is looped through the elongated aperture 96 on the circular segment 32 and stitched directly onto itself, and a second, opposite end indicated generally at 114 which is connected to a first buckle 116 or similar mechanism for removably fastening the first segment 106 to the second segment 108.

Likewise, the third segment 110 has a first end indicated generally at 118 which is looped through the elongated aperture 98 on the circular segment 32 and stitched directly onto itself, and a second, opposite end indicated generally at 120 which is connected to a second buckle 122 or similar mechanism for removably fastening the third segment 110 to the second segment 108. Both the first segment 106 and the third segment 110 are provided with first buckle loops 124 located close to buckles 116 and 122 respectively for retaining the second segment 108 in place. In addition, both the first segment 106 and the third segment 110 are provided with second buckle loops 126 located a distance away from buckles 116 and 122 respectively for further retaining the second segment 108 in position.

The second segment 108 has a first end indicated generally at 128 and a second end indicated generally at 130. Ends 128 and 130 each contain a series of regularly spaced apertures 132 for receiving buckles 116 and 122 respectively when the caveson 102 is fastened onto to the horse's head 36. The relative lengths of each of the segments 106, 108 and 110 is such that when buckles 116 and 122 are fastened, buckle 116 will be located on the right side of the horse's head 36 and buckle 122 will be located on the left side of the horse's head 36.

Figure 10:
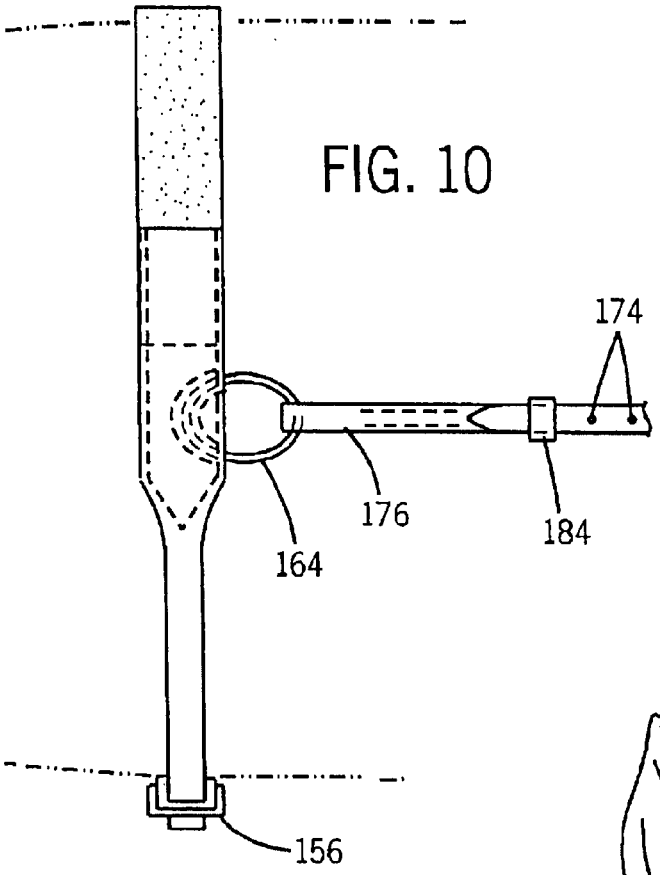
FIG. 10 is a side view of a portion of the caveson illustrated in FIG. 9, showing the connection of the noseband to the jaw strap which forms the circular segment, and also showing the connection of the headstall to the circular segment.
Figure 9:
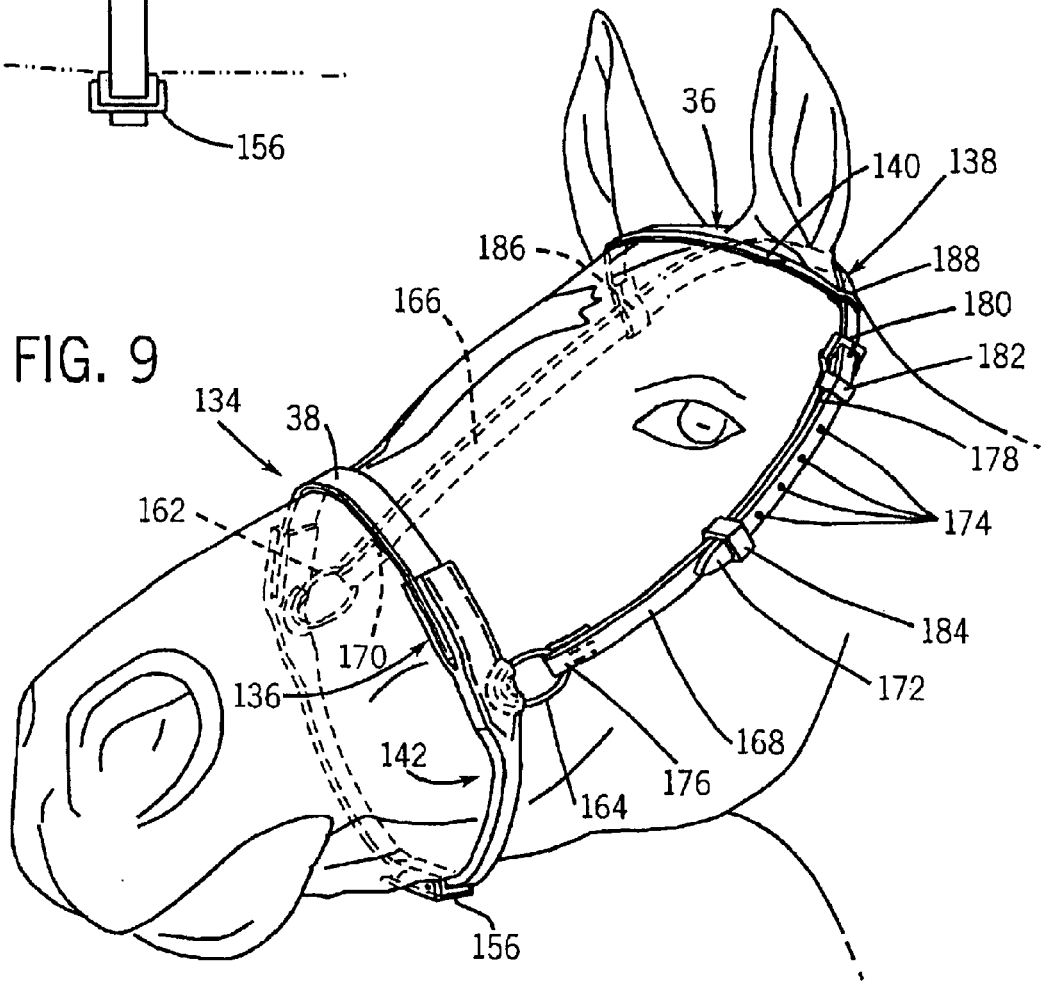
FIG. 9 is a perspective view of a horse wearing a second alternate embodiment caveson, which includes a crown piece.
Figure 11:
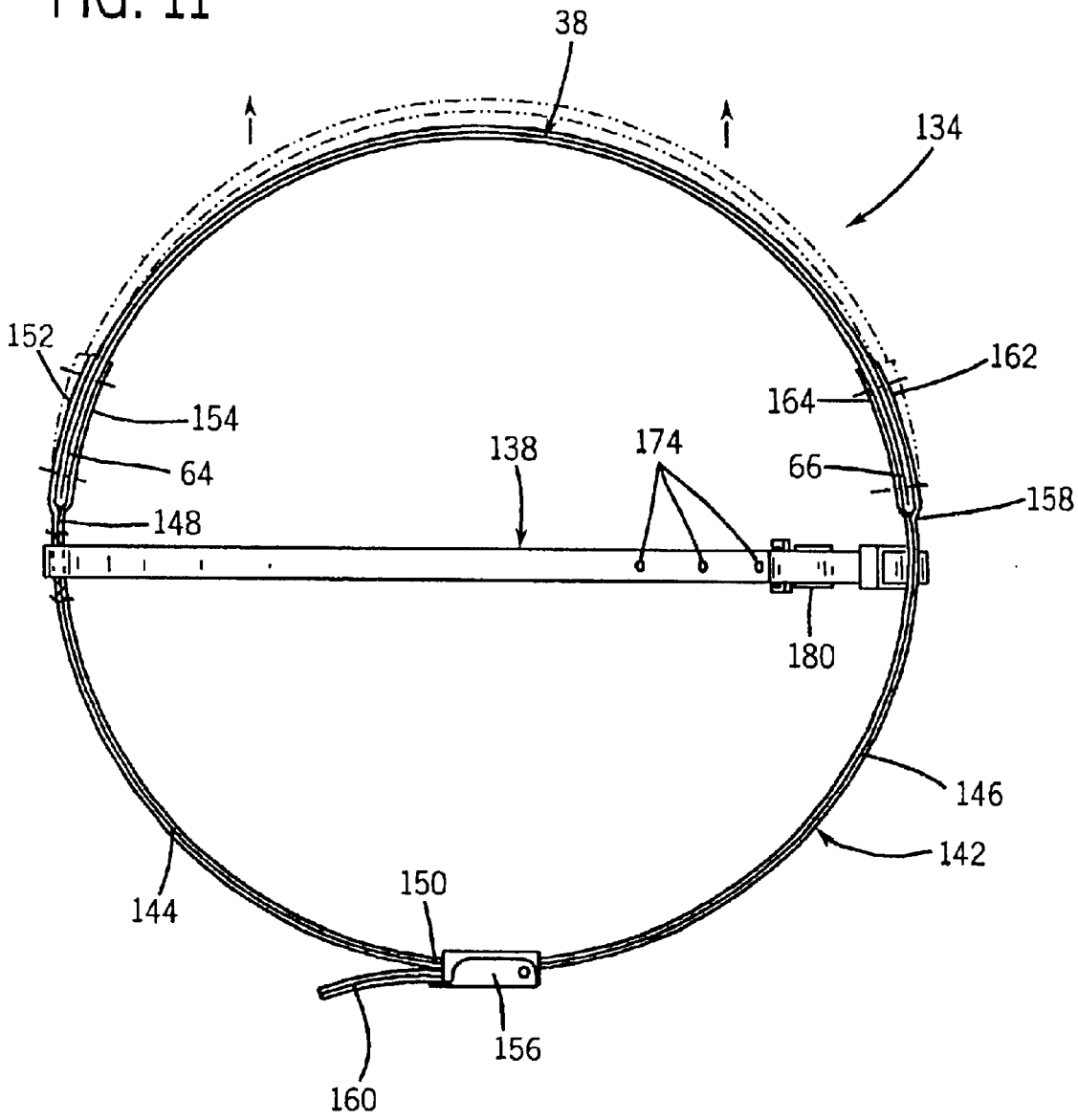
FIG. 11 is a front view of the caveson illustrated in FIGS. 9 and 10.

Referring next to FIGS. 9 through 11, a second alternate embodiment is shown in which a caveson 134 is provided consisting of a circular segment 136 that fits around the horse's nose, a headstall 138 which is connected to the circular segment 136 on opposite sides thereof and runs behind the horse's ears to maintain the caveson 134 in place on the horse's head 36, and a crown piece 140 which is connected to the headstall 138 on opposite sides of the horse's head 36, running along the forehead of the horse.

As best illustrated in FIG. 11, the circular segment 136 consists of a noseband 38 and a jaw strap indicated generally at 142. In this embodiment, the jaw strap 142 consists of two segments, a first segment 144 and a second segment 146. The first segment 144 has a first end indicated generally at 148, and a second, opposite end indicated generally at 150. The first end 148 of the first segment 144 is split into two layers, namely a first layer 152 and a second layer 154. The first end 64 of the noseband 38 is attached to the jaw strap 142 by inserting end 64 between layers 152 and 154 of the first segment 144 and the resulting joint is stitched or otherwise permanently joined together in a manner known to those skilled in the art. The second end 150 of the first segment 144 is connected to a friction-lock buckle 156 or similar mechanism for removably fastening the first segment 144 to the second segment 146 and for adjusting the size of circular segment 136.

Likewise, the second segment 146 has a first end indicated generally at 158, and a second, opposite end indicated generally at 160. The first end 158 of the second segment 146 is split into two layers, namely a first layer 162 and a second layer 164. The second end 66 of the noseband 38 is attached to the jaw strap 142 by inserting end 66 between layers 162 and 164 of the second segment 146 and the resulting joint is stitched or otherwise permanently joined together in a manner known to those skilled in the art. The second end 160 of the second segment 146 will be fed through the friction-lock buckle 156 when the caveson is fastened onto the horse's head 36. It will be appreciated by those skilled in the art that any appropriate fastening mechanism may be used to adjust the size of the circular segment 136 in place of the friction-lock buckle 156.

As best illustrated in FIGS. 9 and 10, the circular segment 136 is provided with a first metal ring 162 and a second metal ring 164 located on opposite sides of the circular segment 136. The first metal ring 162 is attached to the first segment 144 of the jaw strap 142 near the first end 148 by stitching or otherwise permanently joining in a manner known to those skilled in the art the first metal ring 162 to the jaw strap 142. The first metal ring 162 is joined to the jaw strap 142 in a manner such that the first metal ring 162 is only partially sewn into the jaw strap 142, as shown in FIG. 10.

Likewise, the second metal ring 164 is attached to the second segment 146 of the jaw strap 142 near the first end 158 by stitching or otherwise permanently joining in a manner known to those skilled in the art the second metal ring 164 to the jaw strap 142. The second metal ring 164 is joined to the jaw strap 142 in a manner such that the metal ring is only partially sewn into the jaw strap 142, shown in FIG. 10. Note that the metal rings 162 and 164 are located on opposite sides of the circular segment 136, and will be respectively located on the right and left sides of the horse's head 36 when the caveson 134 is installed thereupon.

FIGS. 9 and 10 illustrate detailed views of the caveson 134 of the present invention showing the connection of the headstall 138 to the circular segment 136. The headstall 138 consists of two segments, a first segment 166 and a second segment 168. The first segment 166 has a first end indicated generally at 170 and a second, opposite end indicated generally at 172 which contains a series of regularly spaced apertures 174. The first end 170 of the first segment 166 is connected to the first metal ring 162 on the circular segment 136 located on the right side of the nose of the horse's head 36 by inserting the first end 170 through the first metal ring 162 and stitching or otherwise permanently joining the first end 170 directly onto itself, forming a loop.

The second segment 168 of the headstall 138 has a first end indicated generally at 176 and a second, opposite end indicated generally at 178 which is connected to a buckle 180 or similar mechanism for removably fastening the first segment 166 to the second segment 168. The first end 176 of the second segment 168 is connected to the second metal ring 164 on the circular segment 136 located on the left side of the nose of the horse's head 36 by inserting the first end 176 through the second metal ring 164 and stitching or otherwise permanently joining the first end 176 directly onto itself, forming a loop. The second segment 168 is further provided with a first buckle loop 182 located close to the buckle 180 and a second buckle loop 184 located a distance away from the buckle 180 for retaining the first segment 166 when the headstall 138 is fastened into place.

As best illustrated in FIG. 9, the crown piece 140 has a first end 186 indicated generally at and a second end indicated generally at 188 which are connected to the headstall 138 on opposite sides of the horse's forehead. The first end 186 is looped around the first segment 166 of the headstall 138 at a location that will be located on the right side of the horse's head 36 immediately in front of the ears and stitched or otherwise permanently joined directly onto itself. Likewise, the second end 188 is looped around the first segment 166 of the headstall 138 at a location that will be located on the left side of the horse's head 36 immediately in front of the horse's ears and stitched or otherwise permanently joined onto itself. The positions of the ends 186 and 188 of the crown piece 140 may be slidably adjusted on the first segment 166 of the headstall 138.

Referring next to FIGS. 12 through 17, a third alternate embodiment is shown in which a caveson 190 is provided consisting of a first circular segment 192 that fits around the horse's nose, a second circular segment 194 that connects to the first circular segment 192 and fits around the horse's nose at a point closer to the mouth of the horse than the first circular segment 192, and a headstall 196 that is connected to the first circular segment 192 on opposite sides thereof and runs behind the horse's ears to maintain the caveson 190 in place on horse's head 36.

The first circular segment 192 of the caveson 190 consists of a noseband 198 that runs over the nasal bone of the horse and a jaw strap indicated generally at 200 that makes up the lower portion of the first circular segment 192.

Figure 12:
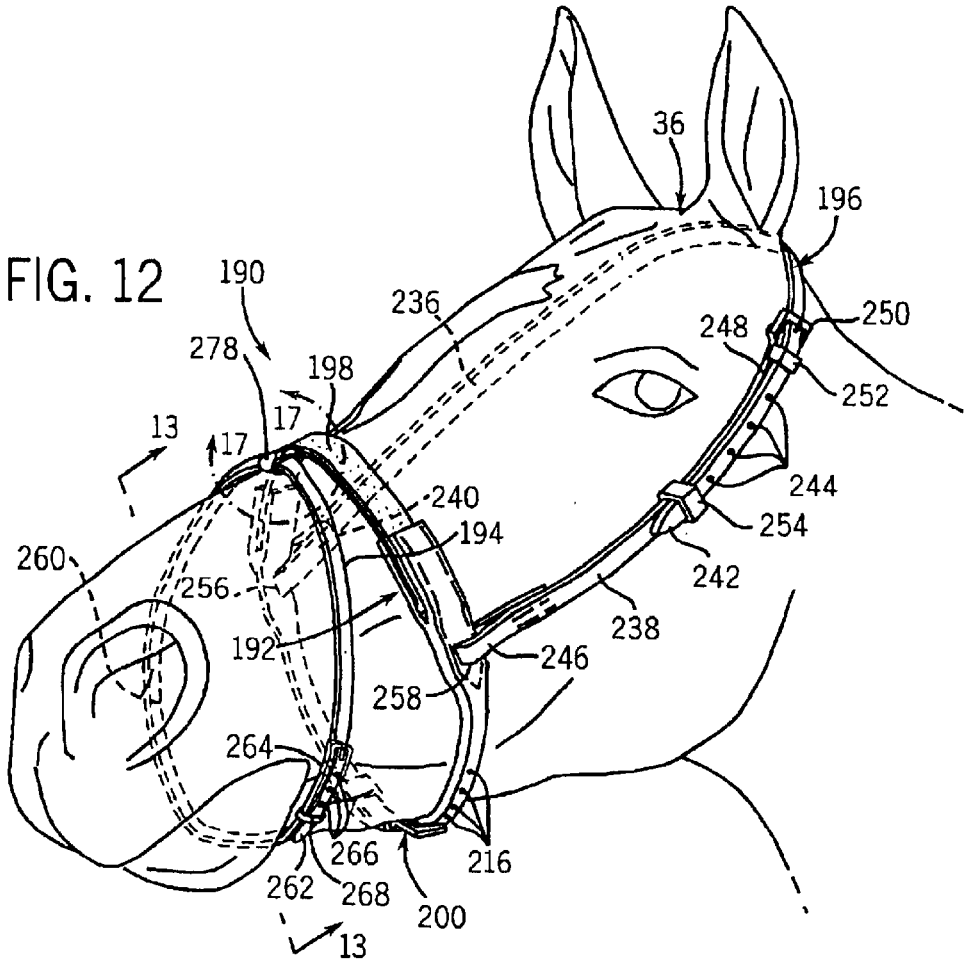
FIG. 12 is a perspective view of a horse wearing a third alternate embodiment caveson, which includes a second circular segment having an adjustment buckle.
Figure 13:
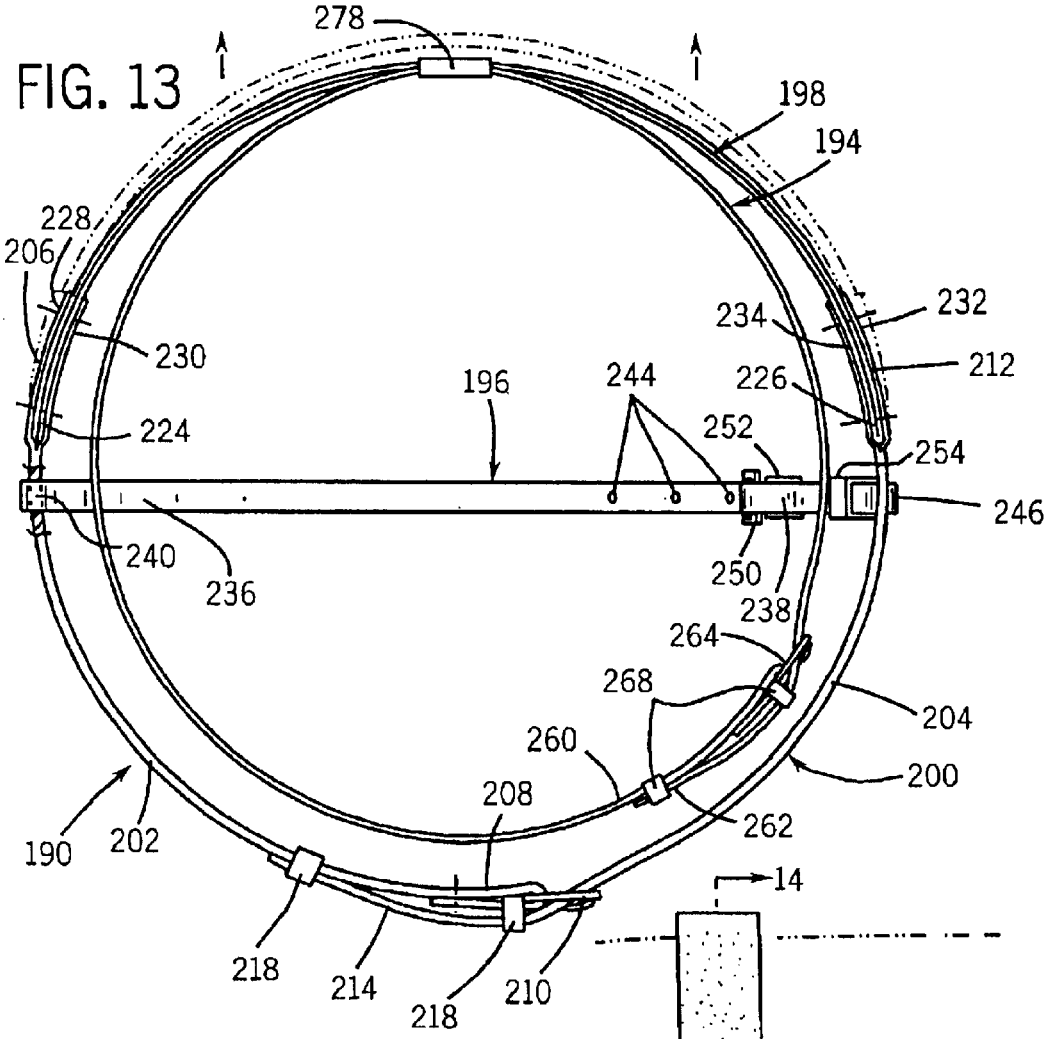
FIG. 13 is a front view of the third alternate embodiment shown in FIG. 12.

As best illustrated in FIGS. 12 and 13, the jaw strap 200 of the caveson 190 is used to adjust the size of the first circular segment 192, to accommodate different size horse noses, and to vary the amount of pressure to be applied to the horse's nose. The jaw strap 200 consists of two segments, a first segment 202 and a second segment 204. The first segment 202 has a first end indicated generally at 206 which is attached to the noseband 198, and a second, opposite end indicated generally at 208 which is connected to a buckle 210 or similar mechanism for removably fastening the first segment 202 to the second segment 204. The second segment 204 has a first end indicated generally at 212 which is attached to the noseband 198, and a second, opposite end indicated generally at 214 which contains a series of regularly spaced apertures 216 (best shown in FIGS. 12 and 15) which will receive the buckle 210.

FIG. 13 best illustrates the manner in which the first segment 202 is provided with buckle loops 218 located close to the buckle 210 for retaining the second end 214 of the second segment 204 after the jaw strap 200 has been buckled into place. The relative lengths of each of the segments 202 and 204 of the jaw strap 200 is such that when the buckle 210 is fastened, it is located on the underside of the horse's nose.

Figure 14:
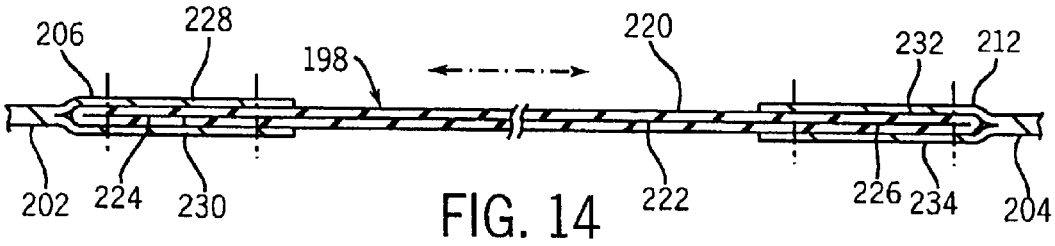
FIG. 14 is a cross-sectional view of the caveson illustrated in FIGS. 12 and 13, showing a detailed depiction of the connection of the noseband to the jaw strap which forms the first circular segment.

Referring for the moment to FIG. 14, the noseband 198 consists of a first layer 220 and a second layer 222 of a resilient material of identical width and length, stitched or otherwise joined together permanently in a manner known to those skilled in the art, forming a single reinforced band of resilient material. The noseband 198 has a first end indicated generally at 224 and a second, opposing end indicated generally at 226, in which ends 224 and 226 are used to connect the noseband 198 to the jaw strap 200. In an alternate embodiment, one or more layers of the noseband 198 may be constructed of a material that is not only elastic but also is soft and conforms to the shape of the horse's nose at the points of contact.

In accordance with this embodiment, the noseband 198 is connected to the jaw strap 200, forming the first circular segment 192 (shown in FIGS. 12 and 13). FIG. 14 also illustrates a detailed view of the connection of the noseband 198 to the jaw strap 200 of this embodiment. The first end 206 of the first segment 202 of the jaw strap 200 is split into two layers, namely a first layer 228 and a second layer 230. The first end 224 of the noseband 198 is inserted between the first layer 228 and the second layer 230, and the resulting joint is stitched or otherwise permanently joined together in a manner known to those skilled in the art.

Likewise, the second end 212 of the second segment 204 of the jaw strap 200 is split into two layers, namely a first layer 232 and a second layer 234. The second end 226 of the noseband 198 is inserted between the first layer 232 and the second layer 234, and the resulting joint is stitched or otherwise permanently joined together in a manner known to those skilled in the art. In this embodiment, the jaw strap 200 is constructed of leather, although it could instead be made of any other appropriate material that either has two layers or may be split into two layers as previously described. It will at once be appreciated by those skilled in the art that the jaw strap 200 may instead be constructed of one or more layers of resilient material, nylon, rope or any other appropriate material and connected to the noseband 198 to form the first circular segment 192 by stitching or in any other manner known to those skilled in the art.

Referring again to FIGS. 12 and 13, the headstall 196 consists of two segments, a first segment 236 and a second segment 238. The first segment 236 has a first end indicated generally at 240 which is attached to the first circular segment 192 on the side thereof which will be located on the right side of the nose of the horse's head 36, and a second, opposite end indicated generally at 242 which contains a series of regularly spaced apertures 244. The second segment 238 has a first end indicated generally at 246 which is attached to the first circular segment 192 on the side thereof which will be located on the left side of the nose of the horse's head 36, and a second, opposite end indicated generally at 248 which is connected to a buckle 250 or similar mechanism for removably fastening the first segment 236 to the second segment 238. The apertures 244 will receive the buckle 250 when the headstall 196 is fastened onto the horse's head 36.

FIG. 12 illustrates the manner in which the second segment 238 of the caveson 190 is provided with a first buckle loop 252 located close to the buckle 250 for retaining the second end 242 of the first segment 236, and a second buckle loop 254 located a distance away from the buckle 250 for further retaining the first segment 236 when the headstall 196 is fastened in place. The relative lengths of each of the segments 236 and 238 is such that when the buckle 250 is fastened, the buckle 250 will rest on the side of the horse's head 36.

Figure 15:
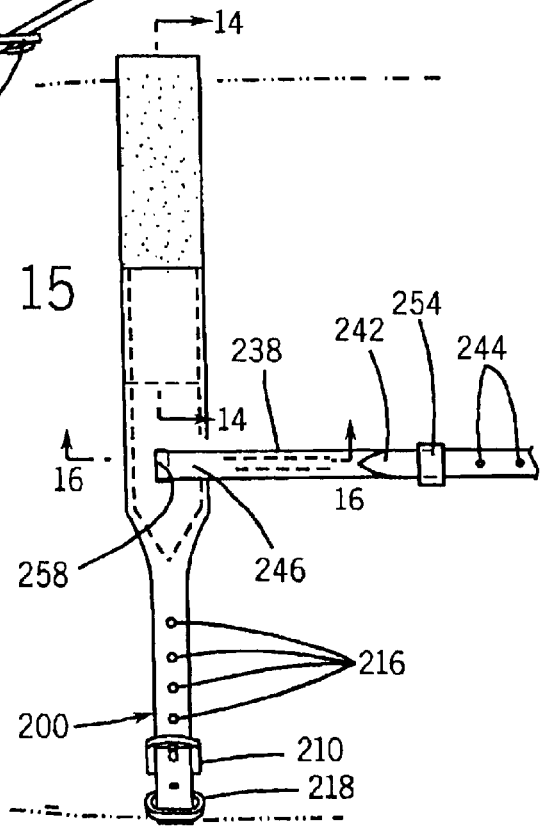
FIG. 15 is a side view of a portion of the caveson illustrated in FIGS. 12 through 14, showing the connection of the noseband to the jaw strap which forms the first circular segment, and also showing the connection of the headstall to the first circular segment.
Figure 16:
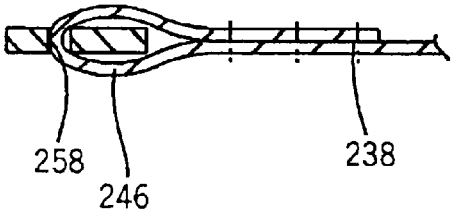
FIG. 16 is a cross-sectional view of the caveson illustrated in FIGS. 14 through 15, showing a detailed depiction of the connection of the headstall to the first circular segment.

Referring now to FIGS. 15 and 16 in addition to FIGS. 12 and 13, detailed views of portions of the caveson 190 of the present invention showing the connection of the headstall 196 to the first circular segment 192 are provided. The first segment 202 of the jaw strap 200 contains an elongated aperture 256 for receiving one end of the headstall 196. The first end 240 of the first segment 236 of the headstall 196 is looped through the elongated aperture 256 and stitched directly onto itself (as shown in FIGS. 15 and 16), or otherwise permanently joined together in a manner known to those skilled in the art.

Likewise, the second segment 204 of the jaw strap 200 contains an elongated aperture 258 for receiving the other end of the headstall 196. The first end 246 of the second segment 238 of the headstall 196 is looped through the elongated aperture 258 and stitched directly onto itself (as shown in FIGS. 15 and 16), or otherwise permanently joined together in a manner known to those skilled in the art. Note that the elongated apertures 256 and 258 are located on opposite sides of the first circular segment 192, and will be respectively located on the right and left sides of the horse's head 36 when the caveson 190 is installed thereupon. It will at once be appreciated by those skilled in the art that the headstall 196 may be connected to the first circular segment 192 as described, or alternatively, by stitching it directly to the first circular segment 192, or by any other mechanism known to those skilled in the art.

As best illustrated in FIGS. 12 and 13, the second circular segment 194 has a first end indicated generally at 260 and a second, opposite end indicated generally at 262. First end 260 is connected to a buckle 264 or similar mechanism for removably fastening the first end 260 to the second end 262. The second end 262 contains a series of regularly spaced apertures 266 (best shown in FIG. 12) which will receive the buckle 264. The first end 260 is provided with buckle loops 268 located close to the buckle 264 for retaining the second end 262 of the second circular segment 194 in place. In this embodiment, the second circular segment 194 is constructed of leather, although it will at once be appreciated by those skilled in the art that the second circular segment 194 may instead be constructed of one or more layers of a resilient material, nylon, rope or any other appropriate material known to those skilled in the art.

FIGS. 12 and 17 illustrate how the second circular segment 194 is attached to the first circular segment 192. In this embodiment, a connecting segment 278 is provided having a first end indicated generally at 280 and a second, opposite end indicated generally at 282. Ends 280 and 282 of connecting segment 278 are inserted between the first layer 220 and the second layer 222 of the noseband 198 and the resulting joint is stitched or otherwise permanently joined together in a manner known to those skilled in the art, forming a loop with aperture 284. Note that the connecting segment 278 is attached to the first circular segment 192 at a point on the noseband 198 that is directly on the topside or bridge of the horse's nose (approximately 180 degrees from the horse's chin).

As best illustrated in FIG. 12, the second circular segment 194 is attached to the first circular segment 192 by inserting the second end 262 of the second circular segment 194 through the aperture 284 created by the connecting segment 278 and the ends 260 and 262 of the second circular segment 194 are fastened together by the buckle 264.

Referring now also to FIG. 18, the third alternate embodiment of the caveson 190 is shown on the horse's head 36 located underneath a bridle 100 as would be customary when used for horse training. Note that the second circular segment 194 encircles the horse's nose around the chin and in front of the bit when the caveson 190 is installed on the horse's head 36 (as shown in FIGS. 12 and 18). It will at once be appreciated by those skilled in the art that the second circular segment 194 may instead be directly connected to the first circular segment 192 at a point on the noseband 198 that is directly at the bridge of the horse's nose (approximately 180 degrees from the horse's chin) by stitching or in any other manner known to those skilled in the art.

Figure 19:
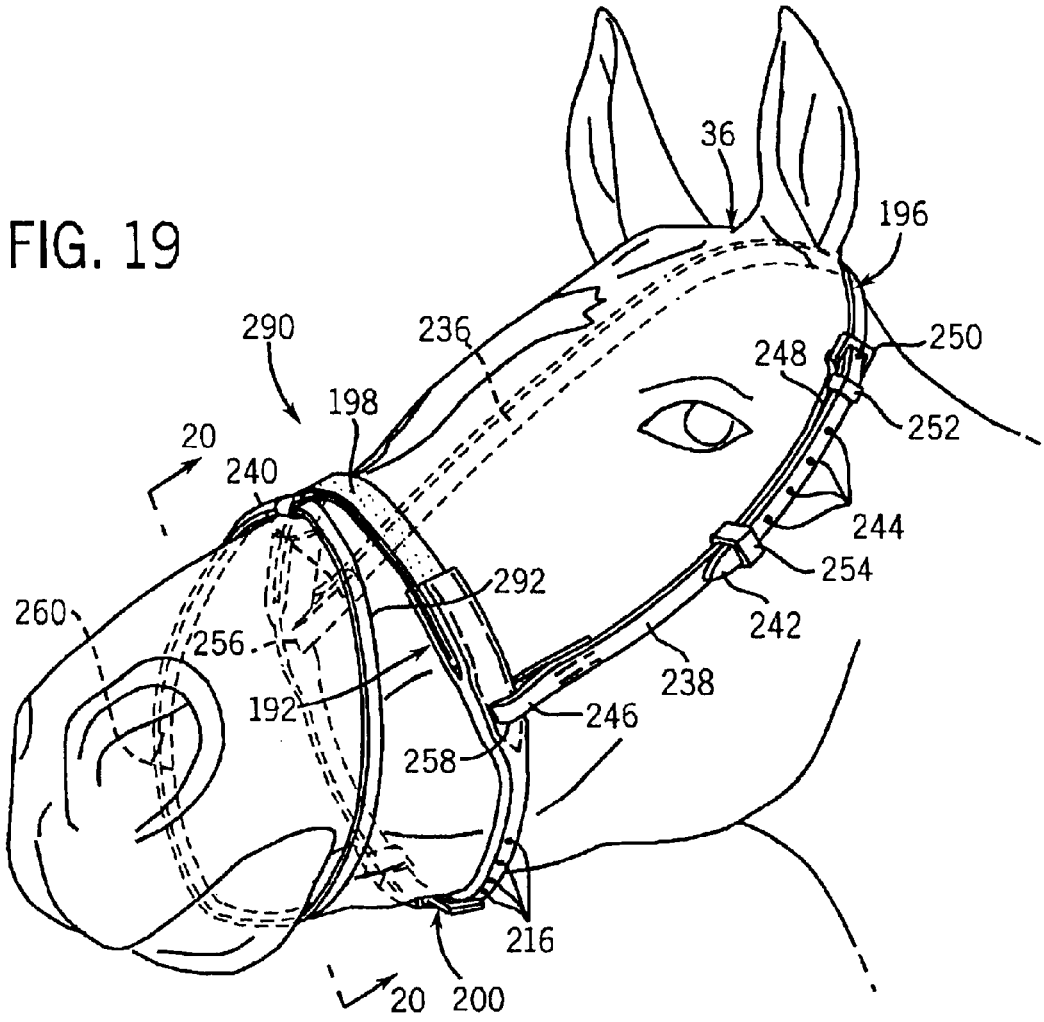
FIG. 19 is a perspective view of a horse wearing a fourth alternate embodiment caveson, which includes a second circular segment without a buckle.
Figure 20:
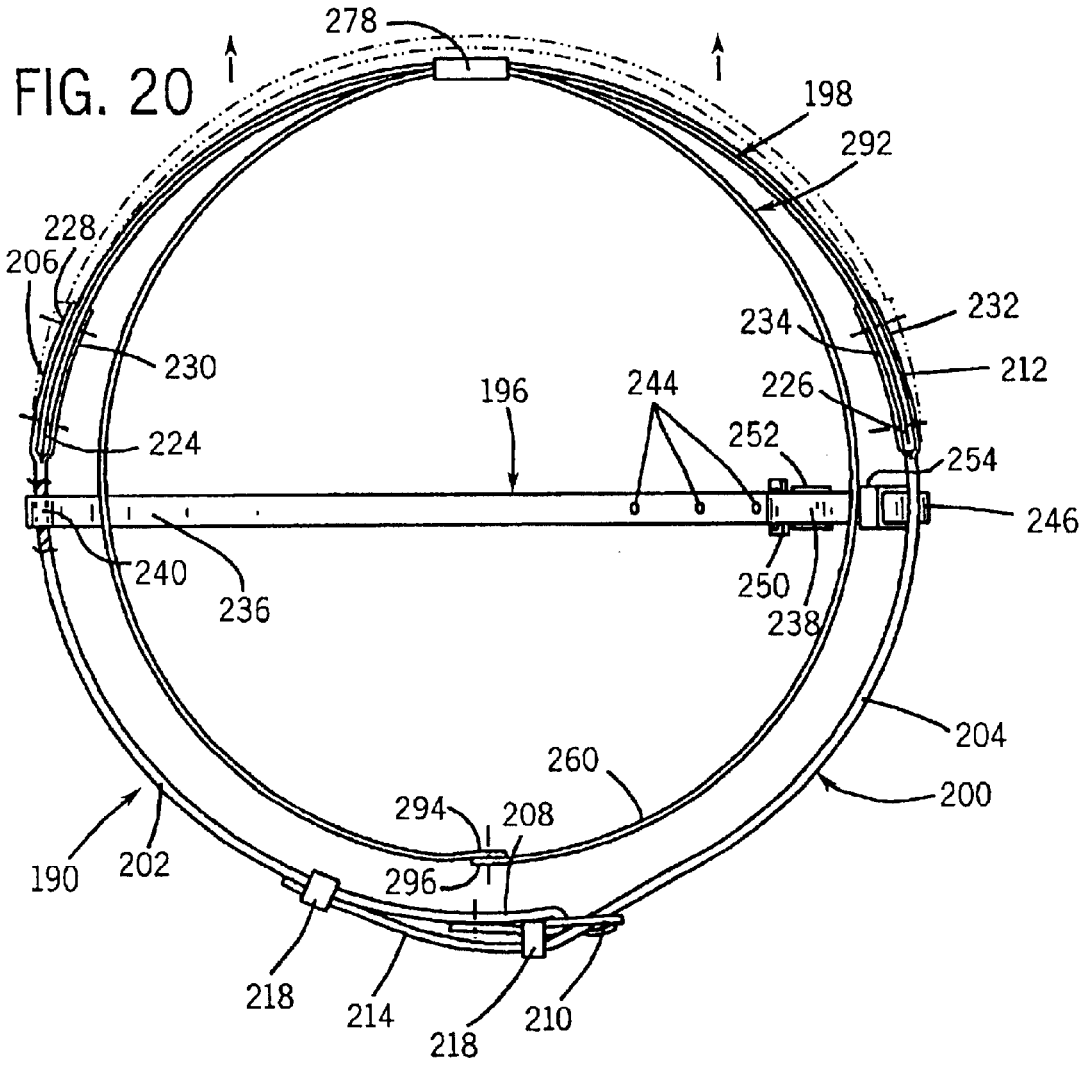
FIG. 20 is a front view of the fourth alternate embodiment shown in FIG. 19.

Referring next to FIGS. 19 and 20, a fourth alternate embodiment is shown in which a caveson 290 is provided consisting of a first circular segment 192 that fits around the horse's nose, a second circular section 292 that connects to the first circular segment 192 and fits around the horse's nose at a point closer to the mouth of the horse than the first circular segment 192, and a headstall 196 that is connected to the first circular segment 192 on opposite sides thereof and runs behind the horse's ears to maintain the caveson 190 in place on horse's head 36.

Note that in this embodiment, the first circular segment 192 and headstall 196 of caveson 290 are constructed in the manner described for the third alternate embodiment. Likewise, the noseband 198 of the first circular segment 192 is provided with connecting segment 278 in the manner previously described, which forms a loop with aperture 284 located at a point on the noseband 198 that is directly at the bridge of the horse's nose (approximately 180 degrees from the horse's chin).

Referring now to FIG. 20, the second circular segment 292 has a first end indicated generally at 294 and a second, opposite end indicated generally at 296. The second circular segment 292 is attached to the first circular segment 192 by inserting the end 294 of the second circular segment 292 through the aperture 284 created by the connecting segment 278 and ends 294 and 296 of second circular segment 292 are stitched together or otherwise joined in a manner known to those skilled in the art. It will at once be appreciated by those skilled in the art that the second circular segment 292 may be directly connected to the first circular segment 192 by stitching or joining them together in any other manner known to those skilled in the art. Note that the second circular segment 292 may be constructed of one or more layers of a resilient material, nylon, rope or any other appropriate material known in the art.

It may therefore be appreciated from the above detailed description of the preferred embodiments of the present invention that the noseband is manufactured, at least in part, of a resilient material as described, while the material used in other components of the caveson may vary depending on the specific use or application thereof.

Although an exemplary embodiment of the caveson of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A caveson comprising:

a noseband constructed of elasticized, resilient material;

a jaw strap, wherein said jaw strap is attached to said noseband to form a circular segment that will fit around the bridge of a horse's nose, said circular segment having right and left side portions which will be respectively located on the right and left sides of the horse's nose; and a headstall having a first end and a second end, wherein said first end of said headstall is attached to said circular segment at said right side portion and said second end of said headstall is attached to said circular segment at said left side portion, said headstall being arranged and configured to extend behind the horse's ears when said caveson is installed;

wherein the resilience of said noseband permits movement of the horse's mouth or jaws while at the same time exerting progressive and constant pressure in response to movement of the horse's mouth or jaws.

2. A caveson as defined in claim 1, wherein said noseband is comprised of two layers of resilient material.

3. A caveson as defined in claim 1, wherein said noseband is comprised of at least one layer of a woven elasticized material that conforms to the shape of a horse's nose at points of contact.

4. A caveson as defined in claim 1, wherein said noseband has a first end and a second end and said jaw strap has a first end and a second end, and wherein said first end of said noseband is attached to said first end of said jaw strap by stitching them together, and wherein said second end of said noseband is attached to said second end of said jaw strap by stitching them together.

5. A caveson as defined in claim 1, wherein said noseband has a first end and a second end and said jaw strap has a first split end and a second split end, and wherein said first end of said noseband is inserted into said first split end of said jaw strap and stitched together, and wherein said second end of said noseband is inserted into said second split end of said jaw strap and stitched together.

6. A caveson as defined in claim 1, wherein said jaw strap comprises an adjustment mechanism for varying the length of said jaw strap, thereby permitting the size of said circular segment to be adjusted depending on the desired amount of pressure to be applied to the horse's nose.

7. A caveson as defined in claim 6, wherein said jaw strap comprises a first segment and second segment, said first segment having a buckle, and said second segment having a plurality of apertures for receiving said buckle to vary the length of said jaw strap, thereby permitting the size of said circular segment to be adjusted to vary the amount of pressure to be applied to the horse's nose.

8. A caveson as defined in claim 6, wherein said jaw strap comprises a first segment and second segment, said first segment having a friction buckle that will receive said second segment to allow the length of said jaw strap to be varied, thereby permitting the size of said circular segment to be adjusted to vary the amount of pressure to be applied to the horse's nose.

9. A caveson as defined in claim 1, wherein said jaw strap is constructed at least in part of a resilient material.

10. A caveson as defined in claim 1, wherein said headstall is constructed at least in part of a resilient material.

11. A caveson as defined in claim 1, wherein said headstall comprises at least one adjustment mechanism for adjusting the size of said headstall.

12. A caveson as defined in claim 11, wherein said adjustment mechanism comprises a buckle.

13. A caveson as defined in claim 1, wherein said headstall has a first end and a second end, wherein said first end of said headstall is attached to said circular segment by inserting said first end of said headstall into a first aperture located on said right side portion of said circular segment and stitching said first end of said headstall over onto itself, and said second end of said headstall is attached to said circular segment by inserting said second end of said headstall into a second aperture located on said left side portion of said circular segment and stitching said second end of said headstall over onto itself.

14. A caveson as defined in claim 1, wherein said headstall has a first end and a second end, wherein said first end of said headstall is attached to said circular segment by stitching said first end of said headstall directly to said circular segment on said right side portion of said circular segment, and said second end of said headstall is attached to said circular segment by stitching said second end of said headstall directly to said circular segment on said left side portion of said circular segment.

15. A caveson as defined in claim 1, said caveson further comprising:

a crown piece having a first end and a second end, wherein said first end of said crown piece is attached to said headstall at a first location which will be located on the right side of the horse's head and said second end of said crown piece is attached to said headstall which will be located at a second location on the left side of the horse's head so that said crown piece runs across the forehead of the horse.

16. A caveson as defined in claim 1, wherein said crown piece is constructed at least in part of a resilient material.

17. A caveson as defined in claim 1, said caveson further comprising:

a second circular segment, wherein said second circular segment is attached to said noseband at a point at the bridge of said horse's nose and encircles said horse's jaw when said caveson is installed thereupon.

18. A caveson as defined in claim 17, wherein said second circular segment is constructed at least in part of one or more layers of a resilient material.

19. A caveson as defined in claim 17, wherein said second circular segment has first and second ends and is attached to said noseband by a connecting segment, wherein said connecting segment is attached to said noseband and forms a loop in which said first end of said second circular segment is fed through said loop and said ends of said second circular segment are joined together.

20. A caveson as defined in claim 17, wherein said second circular segment comprises at least one adjustment mechanism for adjusting the size of said second circular segment.

21. A caveson as defined in claim 17, wherein said adjustment mechanism comprises a buckle.

22. A caveson comprising:

a noseband constructed of two layers of a resilient material, said noseband having a first end and a second end;

a jaw strap, said jaw strap having a first split end and a second split end, wherein said first end of said noseband is inserted into said first split end of said jaw strap and permanently joined together and said second end of said noseband is inserted into said second split end of said jaw strap and permanently joined together, forming a circular segment that will fit around the bridge of a horse's nose, said circular segment having right and left side portions which will be respectively located on the right and left sides of the horse's nose;

a first adjustment mechanism located within said jaw strap for adjusting the size of said circular segment;

a headstall having a first end and a second end, wherein said first end of said headstall is attached to said circular segment at said right side portion and said second end of said headstall is attached to said circular segment at said left side portion, said headstall being arranged and configured to extend behind the horse's ears; and a second adjustment mechanism located within said headstall for adjusting the size of said headstall to fit a particular horse.

23. A caveson as defined in claim 22, wherein said jaw strap comprises at least one layer of resilient material.

24. A caveson as defined in claim 22, wherein said resilient noseband is constructed of two layers of resilient material.

25. A caveson as defined in claim 22, wherein said jaw strap comprises an adjustment mechanism for varying the size of said jaw strap to allow said circular segment to be adjusted.

26. A caveson as defined in claim 22, wherein said headstall comprises at least one layer of resilient material.

27. A caveson as defined in claim 22, wherein said headstall comprises an adjustment mechanism for adjusting the size of said headstall.

28. A caveson comprising:

an elasticized, resilient noseband having a first end and a second end;

a jaw strap having a first and a second end wherein said first end of said noseband is permanently attached to said first end of said jaw strap and said second end of said noseband is permanently attached to said second end of said jaw strap forming a circular segment; and a headstall having a first end and a second end, wherein said first end is attached to said circular segment at one side thereof and said second end is attached to said circular segment at an opposite side thereof, said headstall being arranged and configured to extend behind the horse's ears;

wherein the resilience of said noseband permits movement of the horse's mouth or jaws while at the same time exerting progressive and constant pressure in response to movement of the horse's mouth or jaws.

29. A caveson comprising:

a circular segment for encircling the nose of a horse when said caveson is installed, said circular segment being made at least in part of an elastic, stretchable material to exert resistance when the horse attempts to open its mouth; and a headstall having a first and second ends which are respectively attached to said circular segment at opposite sides thereof, said headstall being arranged and configured to extend behind the horse's ears to retain said circular segment on the horse's nose;

wherein the elasticity of said circular segment permits movement of the horse's mouth or jaws while concurrently exerting progressive and constant pressure in response to movement of the horse's mouth or jaws.

30. A method of making a caveson, comprising:

providing a noseband of an elasticized, resilient material, said noseband having first and second ends;

attaching first and second ends of a jaw strap to said first and second ends of said noseband, respectively, to form a circular segment that will fit around the bridge of the nose of a horse when said caveson is installed, said jaw strap having a first adjustment mechanism which allows the size of said jaw strap to be adjusted;

attaching a first end of a headstall having first and second ends to said circular segment at a first location and attaching said second end of said headstall to said circular segment at a second, opposite location; and installing a second adjustment mechanism in said headstall for adjusting the size of said headstall;

wherein the resilience of said noseband permits movement of the horse's mouth or jaws while concurrently exerting progressive and constant pressure in response to movement of the horse's mouth or jaws.

31. A caveson comprising:

a circular segment for encircling a horse's muzzle when said caveson is installed, said circular segment having upper and lower hemispherical portions, wherein at least one of said upper and lower hemispherical portions of said circular segment is constructed at least in part of an elasticized, resilient material, the elasticity of said circular segment permitting limited movement of the horse's mouth or jaws while concurrently exerting progressive and constant pressure in response to movement of the horse's mouth or jaws;

a headstall having a first end and a second end, wherein said first end of said headstall is attached to said circular segment at a first location which will be located on the right side of the horse's muzzle and said second end of said headstall is attached said circular segment at a second location which will be located on the left side of the horse's muzzle.

32. A caveson as defined in claim 31, wherein said elasticized, resilient material is at least one layer of elasticized fabric.

33. A caveson as defined in claim 32, wherein said adjustment mechanism comprises a buckle.

34. A caveson as defined in claim 31, wherein said resilient material is at least one layer of rubber.

35. A caveson as defined in claim 31, wherein said circular segment further comprises at least one adjustment mechanism for varying the size of said circular segment depending on the amount of pressure to be applied to the horse's nose.

36. A caveson as defined in claim 35, wherein said adjustment mechanism comprises a buckle.

37. A caveson as defined in claim 31, wherein said headstall further comprises at least one adjustment mechanism for adjusting the size of said headstall.

38. A caveson as defined in claim 31, wherein said first end of said headstall is attached to said first location on said circular segment by stitching and said second end of said headstall is attached to said second, opposite location by stitching.

39. A caveson comprising:

a circular segment for encircling a horse's nose and jaw when said caveson is installed on a horse's head, said circular segment having right and left said portions and at least one elasticized, resilient portion, wherein said elasticized, resilient portion of said circular segment permits limited movement of the horse's mouth or jaws while at the same time exerting progressive and constant pressure on the horse's nose without completely restricting movement of the horse's jaw; and a headstall having a first end and a second end, wherein said first end of said headstall is attached to said circular segment at said right side portion and said second end of said headstall is attached to said circular segment at said left side portion, said headstall being arranged and configured to extend behind the horse's ears when said caveson is installed.

40. A caveson as defined in claim 39, wherein said resilient portion is constructed of at least one layer of elasticized fabric.

41. A caveson as defined in claim 39, wherein said resilient portion is constructed of at least one layer of rubber.

42. A caveson as defined in claim 39, wherein said circular segment further comprises at least one adjustment mechanism for varying the size of said circular segment depending on the amount of pressure to be applied to the horse's nose.

43. A caveson as defined in claim 42, wherein said adjustment mechanism comprises a buckle.

44. A caveson as defined in claim 39, wherein said headstall further comprises at least one adjustment mechanism for adjusting the size of said headstall.

45. A caveson as defined in claim 44, wherein said adjustment mechanism comprises a buckle.

46. A caveson as defined in claim 39, further comprising:

a crown piece having a first end and a second end, wherein said first end of said crown piece is attached to said headstall at a first location which will be located on the right side of the horse's head and said second end of said crown piece is attached to said headstall which will be located at a second location on the left side of the horse's head so that said crown piece runs across the forehead of the horse.

47. A caveson as defined in claim 46, wherein said crown piece is constructed at least in part of a resilient material.

48. A caveson comprising:

a circular segment for encircling a muzzle of an animal, said circular segment including at least one resilient section, wherein said at least one resilient section of said circular segment is constructed at least in part of an elastic material, wherein said at least one resilient section of said circular segment permits said circular segment to yield when the animal attempts to open its mouth while at the same time providing progressive and constant resistance to the animal opening its mouth or jaws in response to movement of the horse's mouth or jaws; and a headstall having a first and second ends which are respectively attached to said circular segment at opposite sides thereof, said headstall being arranged and configured to extend behind the animal's ears to retain said circular segment on the animal's nose.

49. A caveson as defined in claim 48, wherein said resilient section is constructed of at least one layer of elasticized fabric.

50. A caveson as defined in claim 48, wherein said resilient section is constructed of at least one layer of rubber.

51. A caveson as defined in claim 48, wherein said circular segment further comprises at least one adjustment mechanism for varying the size of said circular segment depending on the amount of resistance to be exerted by said circular segment on the animal's muzzle.

52. A caveson as defined in claim 51, wherein said adjustment mechanism comprises a buckle.

53. A caveson as defined in claim 48, wherein said headstall further comprises at least one adjustment mechanism for adjusting the size of said headstall.

54. A caveson as defined in claim 53, wherein said adjustment mechanism comprises a buckle.

55. A caveson comprising:

a noseband portion constructed at least in part of an elasticized, resilient material;

a jaw strap portion constructed at least in part of resilient material, wherein said jaw strap is attached to said noseband to form a circular segment for encircling a horse's muzzle, said circular segment having right and left side portions which will be respectively located on the right and left sides of the horse's muzzle, the elasticity of said circular segment permitting movement of the horse's mouth or jaws while at the same time exerting progressive and constant pressure in response to movement of the horse's mouth or jaws; and a headstall constructed at least in part of an elastic material, said headstall having a first end and a second end;

wherein said first end of said headstall is attached to said circular segment at said right side portion and said second end of said headstall is attached to said circular segment at said left side portion, said headstall being arranged and configured to extend behind the horse's ears when said caveson is installed.

56. A caveson as defined in claim 55, wherein said noseband portion, said jaw strap portion and said headstall are constructed of at least one layer of elasticized fabric.

57. A caveson as defined in claim 55, wherein said noseband portion, said jaw strap portion and said headstall are constructed of at least one layer of rubber.

* * * * *